US008060953B1

(12) United States Patent
Dorra

(10) Patent No.: US 8,060,953 B1
(45) Date of Patent: Nov. 22, 2011

(54) AUTO CLEANING TOILET SEAT WITH ANAL CLEANING DEVICE AND BLOW DRY

(75) Inventor: Maximo Dorra, North Miami, FL (US)

(73) Assignee: Auto Cleaning Toilet Seat, L.L.C., North Miami, FL (US)

( * ) Notice: Subject to any disclaimer, the term of this patent is extended or adjusted under 35 U.S.C. 154(b) by 0 days.

(21) Appl. No.: 12/823,873

(22) Filed: Jun. 25, 2010

(51) Int. Cl.
*A47K 13/00* (2006.01)

(52) U.S. Cl. ..... 4/233; 4/444; 4/447

(58) Field of Classification Search ..... 4/233, 420.1–420.2, 420.4–420.5, 4/443–444, 447–448
See application file for complete search history.

(56) References Cited

U.S. PATENT DOCUMENTS

| | | | | |
|---|---|---|---|---|
| 3,247,524 | A | 4/1966 | Umann | |
| 4,558,473 | A | 12/1985 | Morikawa et al. | |
| 4,628,548 | A | 12/1986 | Kurosawa et al. | |
| 5,022,098 | A * | 6/1991 | Brower | 4/233 |
| 5,319,811 | A | 6/1994 | Hauri | |
| 5,359,736 | A | 11/1994 | Olivier | |
| 6,003,159 | A * | 12/1999 | Sadegh et al. | 4/233 |
| 6,105,178 | A | 8/2000 | Kurisaki et al. | |
| 6,769,140 | B1 | 8/2004 | Olivier | |
| 7,096,518 | B2 | 8/2006 | Takenaga | |
| 7,155,755 | B2 | 1/2007 | Olivier | |
| 7,191,473 | B2 | 3/2007 | Matsumoto et al. | |
| 7,216,374 | B2 | 5/2007 | Hassan | |
| 2005/0028263 | A1 | 2/2005 | Wodeslavsky | |
| 2005/0246828 | A1 | 11/2005 | Shirai et al. | |
| 2006/0064810 | A1 | 3/2006 | Teranishi et al. | |

* cited by examiner

*Primary Examiner* — Charles Phillips
(74) *Attorney, Agent, or Firm* — Albert Bordas, P.A.

(57) ABSTRACT

A combined automatic toilet self-cleaning and user hygienic system, comprising a housing assembly, an electrical system, a liquid matter system, a turbine assembly, and a manifold assembly comprising a first at least one cut out. The manifold assembly is partially housed within a manifold. The manifold assembly has ducting for air to flow originating from the turbine assembly. The manifold assembly further comprises a bidet for liquid matter to exit originating from the liquid matter system. A toilet seat assembly has mounting brackets to mount onto the manifold assembly and a cover assembly has a mounting frame to mount onto the manifold assembly. The cover assembly has a second at least one cutout for air to flow originating from the turbine assembly. The cover assembly further has a third at least one cutout for the liquid matter to exit originating from the liquid matter system.

20 Claims, 8 Drawing Sheets

TIME CHARTS
Cover assembly 280 Fig. 8A
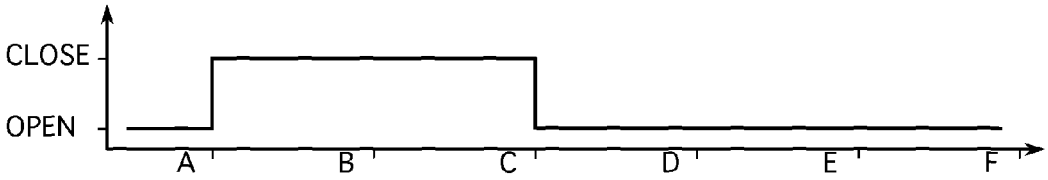
Water and Disinfectant to water duct assembly 320 Fig. 8B
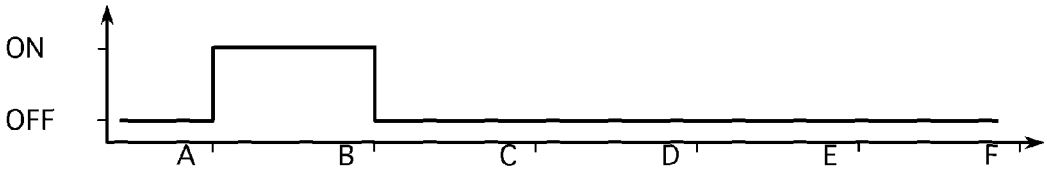
Air from air turbines 100 and 200 to air duct assembly 310 Fig. 8C
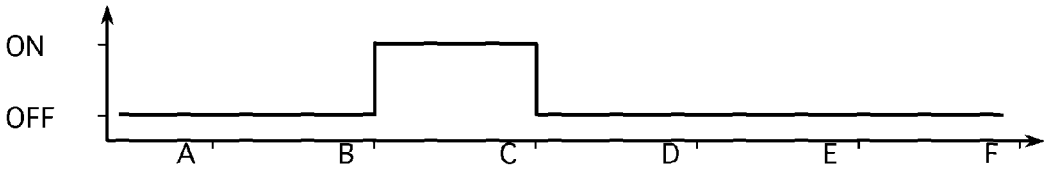
Water from impeller pump 98 to nozzle 122 Fig. 8D
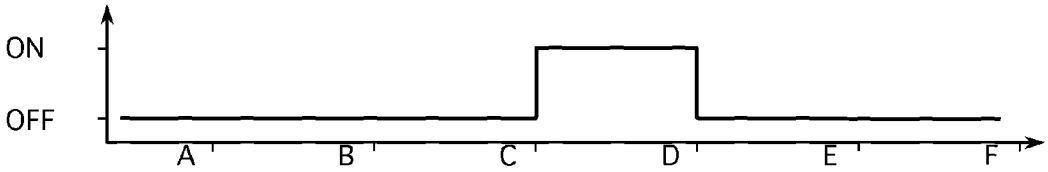
Air from air turbines 100 and 200 to flaps 248 Fig. 8E
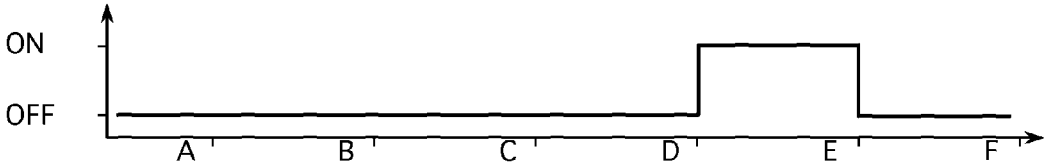

AUTO CLEANING TOILET SEAT WITH ANAL CLEANING DEVICE AND BLOW DRY

BACKGROUND OF THE INVENTION

1. Field of the Invention

The present invention relates to toilet systems, and more particularly, to an automatic toilet seat cleaning system that also serves to hygienically cleanse and dry a user of such system.

2. Description of the Related Art

Applicant believes that one of the closest references corresponds to U.S. Patent Application Publication No. 2006/0064810, published on Mar. 30, 2006 to Teranishi, et al. for a human private part washing apparatus. However, it differs from the present invention because Teranishi, et al. teach a human private part washing apparatus that includes a base, a toilet seat supported by the base to pivot, a washing portion provided at the base and capable of washing at least one private part of a person seated on the toilet seat, a microcomputer-based controller provided at the base and incorporating a storage media, in which at least one program can be stored, and a write connector, which includes at least one terminal and a ground terminal and is capable of writing the at least one program at the storage media, and a connector cover configured to detachably cover the write connector; the connector cover being provided with at least one terminating resistance capable of connecting the at least one opened terminal to the ground terminal.

Applicant believes that another reference corresponds to U.S. Patent Application Publication No. 2005/0246828, published on Nov. 10, 2005 to Shirai, et al. for a hygiene washing apparatus. However, it differs from the present invention because Shirai, et al. teach a hygiene washing apparatus that, when the human body is washed, washing water is sprayed on a surface to be washed of the human body from a posterior nozzle and a bidet nozzle. On the other hand, when the human body is not washed, the posterior nozzle and the bidet nozzle are subjected to high-temperature cleaning by a nozzle cleaning nozzle. When it is detected that a sanitary washing apparatus has not been employed yet, the posterior nozzle and the bidet nozzle are allowed to be cleaned by the nozzle cleaning nozzle by a controller. After a cleaning operation is terminated, a user is notified that the cleaning operation is terminated by a notification lamp and a speaker. A scale inhibiting material supply device is interposed in a pipe on the upstream side of an instantaneous heating device by the nozzle cleaning nozzle.

Applicant believes that another reference corresponds to U.S. Patent Application Publication No. 2005/0028263, published on Feb. 10, 2005 to Wodeslavsky for a water and space conservation toilet/bidet combination. However, it differs from the present invention because Wodeslavsky teaches a dual purpose toilet bowl which consists water conservation system which also consists a built in bidet, and this water conservation system is functioning by two stages of the toilet flushing, the first state it is by pressurized water and by gravity simultaneously whereby the gravity tradition flushing method is incorporating a water pressure method being controlled by a proportion valve. The second stage, most of the water will come from the gravity dumping valve. The proportion valve will control the amount of water that will be injected to the toilet bowl relative to the amount of water that will be dumped from the tank by the gravity. The pressurized water is aiming to the bottom of said toilet bowl where the waste is being accumulated whereby the flushing cycle based on water injection into the bottom of said bowl for few seconds in order to create the first push of the waste and simultaneously water dumping until the water will be diverted from the bottom of the toilet to the toilet tank, and said toilet bowl will also consist a bidet apparatus in order to save water on toilet flushing. This bidet apparatus consists safety valves and drainage to ensure that the waste will not go backwards to the fresh water. This bidet nozzle can wash itself and also this nozzle can rinse with soap and also this nozzle can dry the user by warm air.

Applicant believes that another reference corresponds to U.S. Pat. No. 7,216,374 issued to Hassan on May 15, 2007 for a smart toilet seat. However, it differs from the present invention because Hassan teaches a multi-function toilet seat having a body including an oval and arcuate shaped portion, defining an ergonomically configured upper surface and an open interior. A rear portion interconnects opposite extending ends of the arcuate shaped portion. A fluid inlet plug extends from a first location associated with the body and communicates with a plurality of succeeding and interior extending passageway channels. The channels communicate in turn with a plurality of spray nozzles located at spaced locations along an inner defining surface of the seat. A suction outlet extends from a second location associated with the body and communicates with an exhaust motor incorporated into the rear portion. A plurality of exhaust apertures extend along spaced inner locations of the seat and evacuate an airflow from within an associated toilet bowl interior and through the suction outlet.

Applicant believes that another reference corresponds to U.S. Pat. No. 7,191,473 issued to Matsumoto, et al. on Mar. 20, 2007 for a sanitary washing apparatus. However, it differs from the present invention because Matsumoto, et al. teach a sanitary washing apparatus that, when a user sets water power using a water power adjustment switch in a remote control device, a controller controls the period of pressure fluctuations, the width of pressure fluctuations, and the central pressure of the discharge pressure of a pump on the basis of a signal transmitted by radio from the remote control device. When the user sets the divergent angle of washing water using a washing area adjustment switch in the remote control device, the controller controls the divergent angle of the washing water sprayed from a posterior nozzle on the basis of the signal transmitted by radio from the remote control device. Consequently, the washing water supplied to a side surface of a cylindrical swirl chamber from a first flow path in the posterior nozzle is sprayed from a spray hole as dispersed spiral flow, and the washing water supplied to a lower part of the cylindrical swirl chamber from a second flow path in the posterior nozzle is sprayed from the spray hole as linear flow.

Applicant believes that another reference corresponds to U.S. Pat. No. 7,155,755 issued to Olivier on Jan. 2, 2007 for a toilet seat having a cleansing facility. However, it differs from the present invention because Olivier teaches a toilet seat (10) having a cleansing facility with an pivotable arm (18) supplied with warm water for cleaning and warm air for drying the anal and genital areas of a user. The arm (18) being automatically controlled to operate along a path substantially parallel with the central fore and aft axis of the toilet seat (10) between a stored position and an active position. The water is supplied though a duct (36), which has a relatively small cross-sectional area and the air, is supplied through a duct (44) having a relatively large cross-sectional area so as to provide respectively differing volumes of fluid to the user. The water duct (36) and air duct (44) are substantially parallel and both terminate in upward disposition to direct the water and air upwardly onto the user at a close range for efficient cleaning and drying, respectively. The toilet seat (10) has a bi-directional fan (50) that rotates clockwise for delivering air to the anal area of the user and anti-clockwise for delivering air to the genital area of the user. A heater coil (49) is provided in the air duct (44) and optionally upstream of the fan (50). A second water outlet (60) is provided for cleaning male genitals and can be manipulated to adjust its orientation.

Applicant believes that another reference corresponds to U.S. Pat. No. 7,096,518 issued to Takenaga on Aug. 29, 2006 for a body part cleansing unit for toilet. However, it differs from the present invention because Takenaga teaches a body washing unit for a toilet stool, comprising: a case body disposed on the upper surface of a toilet-stool main body, a toilet seat and a toilet-seat cover being connectable to the case body so as to hinge; and a warm-water nozzle incorporated into the case body, wherein cold water in a duct passage for the warm-water nozzle is discharged, before the warm-water nozzle is used.

Applicant believes that another reference corresponds to U.S. Pat. No. 6,769,140 issued to Olivier on Aug. 3, 2004 for a toilet seat having a cleansing facility. However, it differs from the present invention because Olivier teaches a toilet seat (10) having a cleansing facility with an pivotable arm (18) supplied with warm water for cleaning and warm air for drying the anal and genital areas of a user. The arm (18) being automatically controlled to operate along a path substantially parallel with the central fore and aft axis of the toilet seat (10) between a stored position and an active position. The water is supplied though a duct (36), which has a relatively small cross-sectional area and the air, is supplied through a duct (44) having a relatively large cross-sectional area so as to provide respectively differing volumes of fluid to the user. The water duct (36) and air duct (44) are substantially parallel and both terminate in upward disposition to direct the water and air upwardly onto the user at a close range for efficient cleaning and drying, respectively. The toilet seat (10) has a bi-directional fan (50) that rotates clockwise for delivering air to the anal area of the user and anti-clockwise for delivering air to the genital area of the user. A heater coil (49) is provided in the air duct (44) and optionally upstream of the fan (50). A second water outlet (60) is provided for cleaning male genitals and can be manipulated to adjust its orientation.

Applicant believes that another reference corresponds to U.S. Pat. No. 6,105,178 issued to Kurisaki, et al. on Aug. 22, 2000 for a sanitary cleansing apparatus. However, it differs from the present invention because Kurisaki, et al. teach a sanitary cleansing apparatus 20 with attachment state sensor 180 for detecting the state of attachment to toilet bowl 21. When OFF signal is output from attachment state sensor 180, first closing valve 137a is closed at step S82 and power supply to cleansing water heater 129 is stopped at step S84; shower nozzle 24 is finally stored in standby position. Therefore, troubles are fairly prevented since shower nozzle 24 is stored in standby position with inhibition of water spouting function when sanitary cleansing apparatus 20 is detached from toilet bowl 21.

Applicant believes that another reference corresponds to U.S. Pat. No. 5,359,736 issued to Olivier on Nov. 1, 1994 for a spray means for a toilet pedestal. However, it differs from the present invention because Olivier teaches a bidet device useable with a toilet has a nozzle (82) which supplies water in an accurate confined spray to the anal or genital area followed by air blown through the same nozzle so as to dry the wetted areas. Both water and air are electrically heated in unit (12) under thermostatic control. A hand grip (60) is used to slide spray conduit (62) and nozzle (82) from a storage position under the lop of the toilet bowl to an appropriate longitudinal position. Switch (52) is then used to control a low voltage circuit, which energizes solenoid valves for the alternate supply of water and air. The unit will not operate unless both microswitch (80) [activated by cam (78)] and a pressure switch responding to the user's weight, are closed. In alternative arrangements the spray assembly is carried on an arm turning on a vertical pivot attached to the toilet pedestal or it forms part of a hand-held wand having no attachment to the toilet pedestal.

Applicant believes that another reference corresponds to U.S. Pat. No. 5,319,811 issued to Haurion on Jun. 14, 1994 for a closet seat for a water closet as well as an apparatus for cleaning the posterior on a water closet having a seat. However, it differs from the present invention because Haurion teaches a water closet that includes a toilet bowl, a toilet seat liftably and lowerably mounted on the toilet bowl, and an apparatus supported adjacent the toilet seat for the personal hygiene of the occupant of the water closet. The apparatus comprises a tank for storing water therein; and an air pump connected with the tank for introducing compressed air into the tank to place a volume thereof under pneumatic pressure. The air pump includes an actuating member for operating the air pump. The apparatus further has a spraying device connected to the tank and supported in a zone of the toilet seat for discharging, from the tank, water driven by the pneumatic pressure to clean the posterior of the occupant. A valve is connected between the tank and the spraying device. The valve has a closed position in which water is prevented from being discharged by the spraying device and an open position in which water is discharged from the spraying device.

Applicant believes that another reference corresponds to U.S. Pat. No. 4,628,548 issued to Kurosawa, et al. on Dec. 16, 1986 for a device and method of moving and controlling the position of a slidable body such as used for body cleansing. However, it differs from the present invention because Kurosawa, et al. teach a device for moving a cleansing nozzle connected to a water supply system that includes an elongated nozzle, a cylinder in which the nozzle is axially slidable, a motor having an output shaft, a drum body mounted on the output shaft, the drum body having a cylindrical rim surface and a sectoral recess extending from the surface, a sectoral insert disposed in the recess and having a partial cylindrical surface conforming to and forming a continuation of the cylindrical rim surface, and a leaf spring having one end connected to the nozzle and the other end held between the drum body and the sectoral insert such that rotation of the drum body extends and withdraws the nozzle longitudinally as the leaf spring unwraps and wraps around the drum body. The method includes counting the number of cycles of the frequency of the electric power supplied to the motor, determining the actual position of the nozzle on the basis of the counted pulses, establishing a predetermined position of the nozzle, comparing the actual position with the predetermined position, and transmitting the results of the comparison to a power circuit for the motor to turn the motor on and off so that the motor thereby positions the slidable nozzle at the predetermined position.

Applicant believes that another reference corresponds to U.S. Pat. No. 4,558,473 issued to Morikawa, et al. on Dec. 17, 1985 for sanitary cleaning equipment. However, it differs from the present invention because Morikawa, et al. teach a sanitary cleaning equipment, which includes a flushing portion adapted to direct a jet of cleaning water against a selected area, a deodorizing portion for withdrawing odoriferous air from the neighborhood of the selected area and deodorizing the same, and a dryer portion adapted to direct a jet of warm air against the area. The above deodorizing portion has a first wind tunnel including a deodorant and the above dryer portion has a second wind tunnel including a heater, the first and second wind tunnels being constructed so that they are selectively communicated with a single fan by switching operation of a damper device, thereby providing a sanitary cleaning equipment which is compact and has a high warm air blowing efficiency and a high deodorization efficiency.

Applicant believes that another reference corresponds to U.S. Pat. No. 3,247,524 issued to Umann, on Apr. 26, 1966 for a hygienic apparatus for use on toilet bowls. However, it differs from the present invention because Umann teaches a hygienic apparatus for use on toilet bowls adapted to be mounted on a toilet bowl in place of the conventional seat, and which is arranged to direct a jet of warm water of small diameter at the anus or adjacent body openings in such a manner that the water is confined essentially to the relatively small region to be cleaned rather than covering large areas of the buttocks. Because the water jet is confined to the region to be cleansed, not only is a minimum volume of warm water required but also a minimum of warm air is required to dry the region, thereby permitting construction of the apparatus in a particularly compact form and minimizing the amount of electrical power required to heat the water and air. Components, such as a water heater, air heater and blower, regulator and shut-off valve, and vacuum relief valve are all contained in a compact housing secured at the rear of the toilet bowl, forwardly of the flush tank; and wherein the toilet seat and cover are hinged or otherwise joined to the housing to form therewith an integral unit, which may be readily attached to the conventional toilet bowl. The hygienic apparatus incorporates means whereby a preliminary supply of water is maintained at essentially body temperature, so that even the initial portion of the water contacting the body does not produce a temperature shock; and is so arranged that a douche attachment may be quickly attached or removed, and which eliminates the need of a long hose line between the hygienic apparatus and the douche tip.

Other patents describing the closest subject matter provide for a number of more or less complicated features that fail to solve the problem in an efficient and economical way. None of these patents suggest the novel features of the present invention.

SUMMARY OF THE INVENTION

The instant invention is a combined automatic toilet self-cleaning and user hygienic system, comprising a housing assembly, an electrical system, a liquid matter system, a turbine assembly, and a manifold assembly comprising a first at least one cut out. The manifold assembly is partially housed within a manifold. The manifold assembly has ducting for air to flow originating from the turbine assembly. The manifold assembly further comprises a bidet for liquid matter to exit originating from the liquid matter system. The instant invention also comprises a toilet seat assembly having mounting brackets to mount onto the manifold assembly and a cover assembly having a mounting frame to mount onto the manifold assembly. The cover assembly has a second at least one cutout for air to flow originating from the turbine assembly. The cover assembly further has a third at least one cutout for the liquid matter to exit originating from the liquid matter system.

The liquid matter exits from the third at least one cutout when the cover assembly is in a closed position. Air flows from the first at least one cut out when the cover assembly is in a closed position. The liquid matter exits from the bidet when the cover assembly is in an open position. The manifold comprises at least one manifold flap that opens when air flows therefrom, originating from the turbine assembly when the cover assembly is in an open position. The cover assembly further comprises a protrusion that rests upon the toilet seat assembly when the cover assembly is in a closed position. The liquid matter system comprises a disinfectant container and a pressure regulator to regulate pressure of the liquid matter exiting from the bidet when the cover assembly is in an open position. The electrical system comprises at least one switch to activate the liquid matter system and the turbine assembly.

The bidet is in a retracted position when the liquid matter exits from the third at least one cutout when the cover assembly is in a closed position. The bidet is also in a retracted position when air flows from the first at least one cut out when the cover assembly is in a closed position. The bidet is however in a extracted position when the liquid matter exits from the bidet when the cover assembly is in an open position. The bidet is also in a retracted position when the at least one manifold flap opens and air flows, therefrom originating from the turbine assembly when the cover assembly is in an open position.

The turbine assembly has sufficient power to displace the liquid matter from the toilet seat assembly when air flows from the first at least one cut out when the cover assembly is in a closed position. The housing assembly comprises at least one tower assembly to house the turbine assembly. The liquid matter system connects to a water source. In a preferred embodiment, the housing assembly comprises two tower assemblies to each house a respective the turbine assembly. The ducting extends from the two tower assemblies to the manifold assembly. The housing comprises a base switch housing to house at least one switch to activate the liquid matter system and the turbine assembly. The manifold assembly, manifold, mounting brackets, and mounting frame are on a same axis.

It is therefore one of the main objects of the present invention to provide an automatic toilet seat cleaning system.

It is another object of this invention to provide an auto cleaning toilet seat with anal cleaning device and blow dry that disinfects the toilet seat before use.

It is another object of this invention to provide an apparatus that washes and dries the anus and adjacent body opening areas of a user after using a toilet.

It is another object of this invention to provide an auto cleaning toilet seat with anal cleaning device and blow dry that is volumetrically efficient.

It is another object of this invention to provide an auto cleaning toilet seat with anal cleaning device and blow dry which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 6B is a partially sectioned isometric view of the instant invention, showing the bidet nozzle retracted and manifold flaps in an open position, whereby forced air expels from.

FIGS. 8A, 8B, 8C, 8D, and 8E are timing charts of the instant invention.

DETAILED DESCRIPTION OF THE PREFERRED EMBODIMENT

Figure 1:
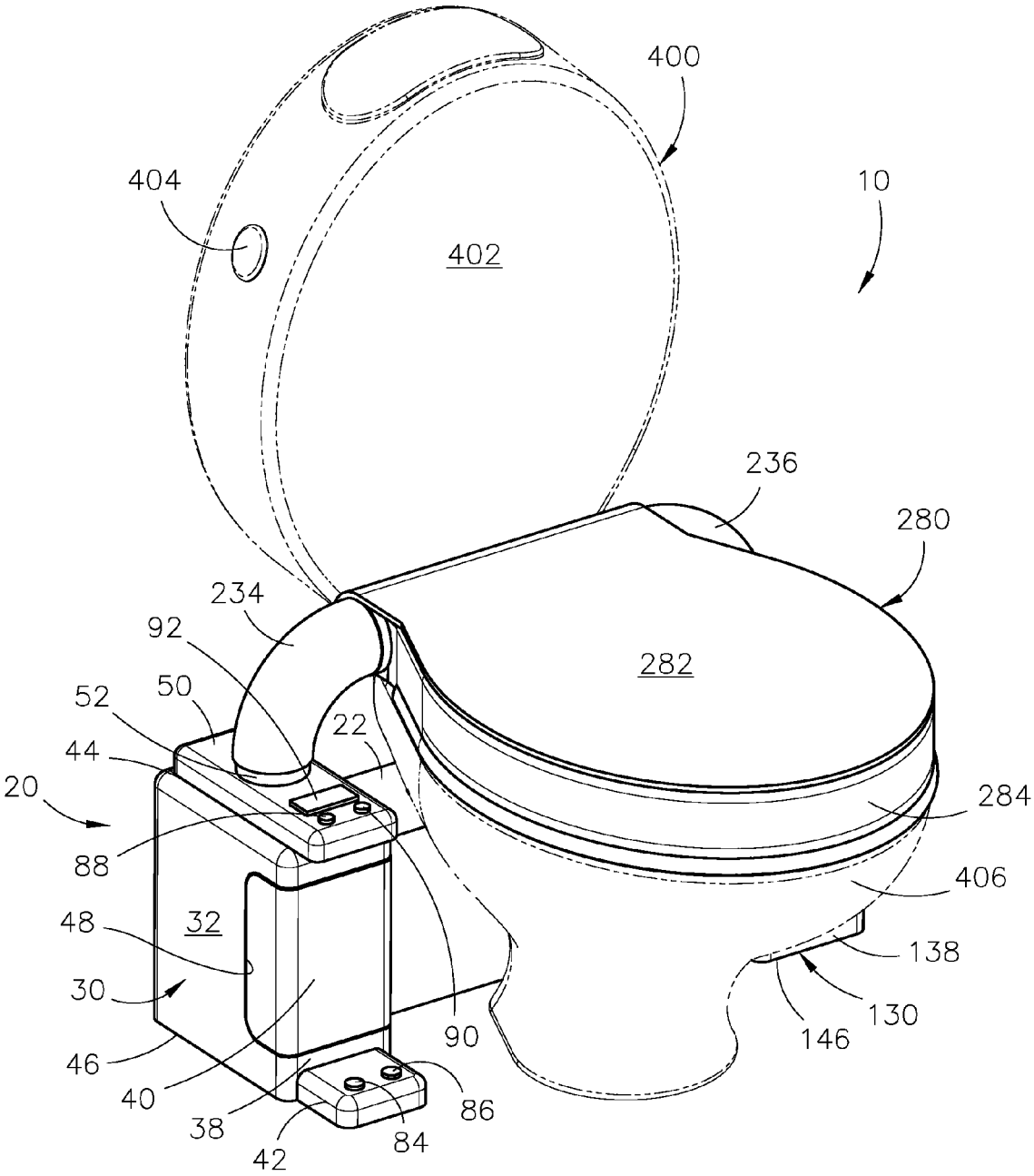
FIG. 1 is an isometric view of the instant invention with its cover assembly in a closed position and installed onto a standard toilet.

Referring now to the drawings, the present invention is a combined automatic toilet self-cleaning and user hygienic system and is generally referred to with numeral 10. It can be observed that it basically includes housing assembly 20, electrical system 80, liquid matter system 110, turbine assemblies 100 and 200, manifold assembly 220, manifold 240, toilet seat assembly 270, and cover assembly 280.

As seen in FIG. 1, instant invention 10 is mounted to toilet 400, which comprises tank 402 with flush button 404, and toilet bowl 406. Housing assembly 20 comprises bridge 22 connecting tower assemblies 30 and 130 cooperatively mounted at lateral sides of toilet 400. Bridge 22 is preferably positioned behind a base of toilet bowl 406.

Figure 2:
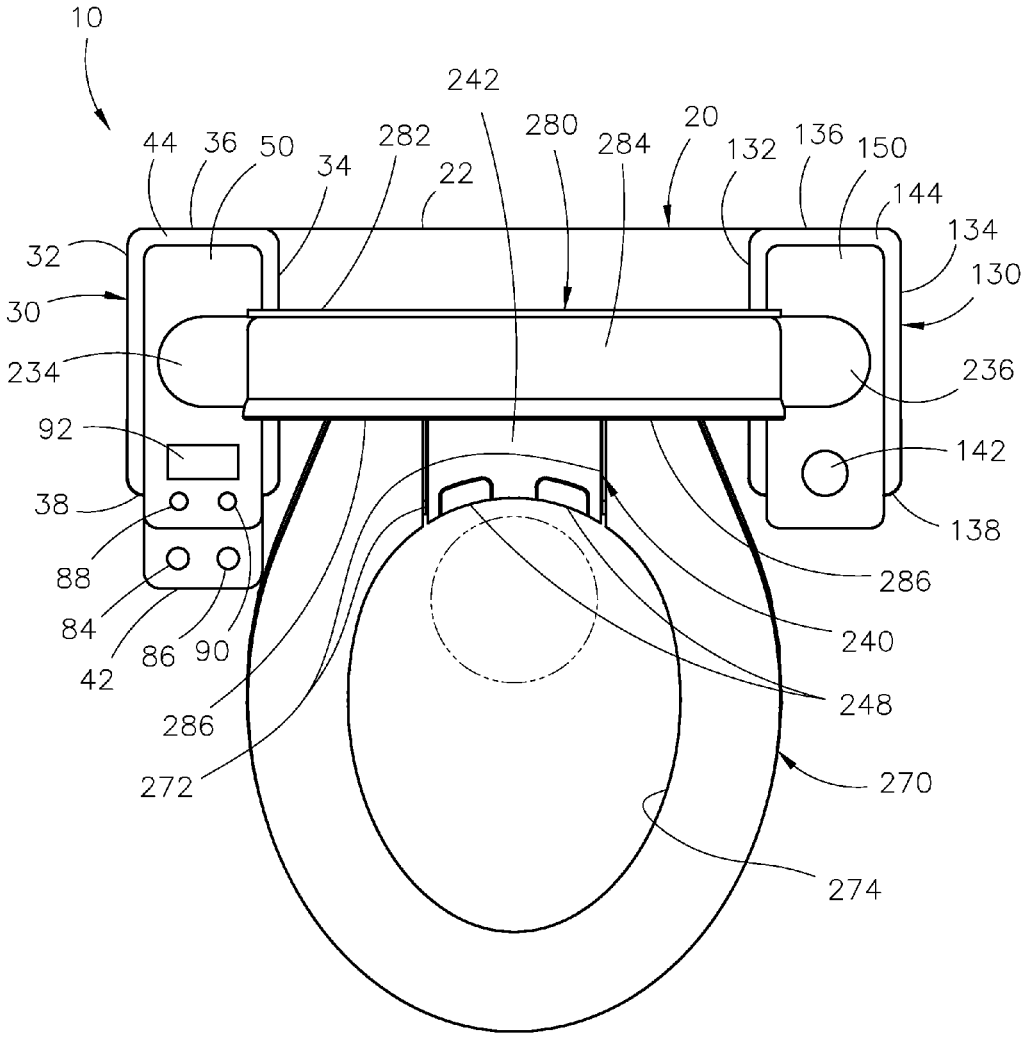
FIG. 2 is a top plan view of the instant invention with its cover assembly in an open position and installed onto the standard toilet, whereby the tank of the toilet has been removed for illustrative purposes.

As best seen in FIG. 2, tower assembly 30 comprises lateral walls 32 and 34, rear wall 36, front wall 38, base switch housing 42, top wall 44, base 46 as seen in FIG. 1, and top switch housing 50 mounted onto top wall 44. Similarly, tower assembly 130 comprises lateral walls 132 and 134, rear wall 136, front wall 138, pressure regulator 142, top wall 144, base 146 as seen in FIG. 1, and top regulator housing 150 mounted onto top wall 144.

Figure 3:
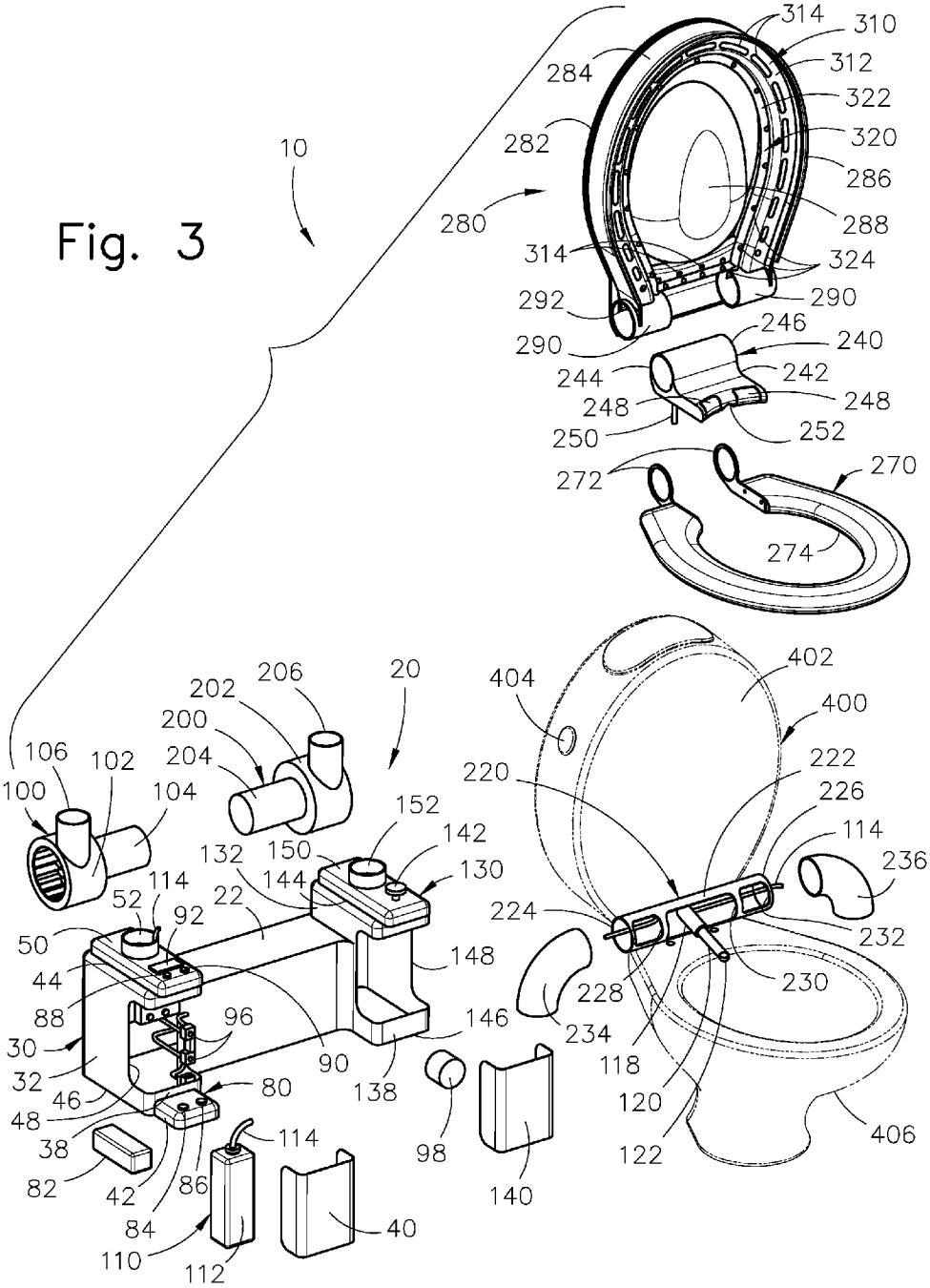
FIG. 3 is an exploded view of the instant invention.

As seen in FIG. 3, front wall 38 of tower assembly 30 has front cover panel 40 removably mounted to cutout 48. Conduit 52 extends upwardly from top switch housing 50. Front wall 138 of tower assembly 130 has front cover panel 140 removably mounted to cutout 148. Conduit 152 extends upwardly from top regulator housing 150.

Electrical system 80 comprises control box 82 with switches 84 and 86 disposed at base switch housing 42, and switches 88 and 90 disposed at top switch housing 50. In a preferred embodiment, screen 92 is positioned at top switch housing 50 and functions to give a status of instant invention 10. Electrical system 80 further comprises electrical wiring 94, seen in FIG. 7, electrical valves 96 and impeller pump 98. Pressure regulator 142 is connected to impeller pump 98. Pressure regulator 142 functions to regulate liquid matter pressure exiting bidet base 118 having telescopic section 120, and specifically bidet nozzle 122. Such liquid matter may be, but is not limited too, water, water combined with other matter such as a chemical, a chemical solution, and/or a chemical solution comprising a disinfectant as an example.

Turbine assembly 100 is housed within tower assembly 30 and comprises housing 102, motor housing 104 and outlet 106. Outlet 106 connects to conduct 52. Similarly, turbine assembly 200 is housed within tower assembly 130 and comprises housing 202, motor housing 204 and outlet 206 that connects to conduit 152.

Figure 7:
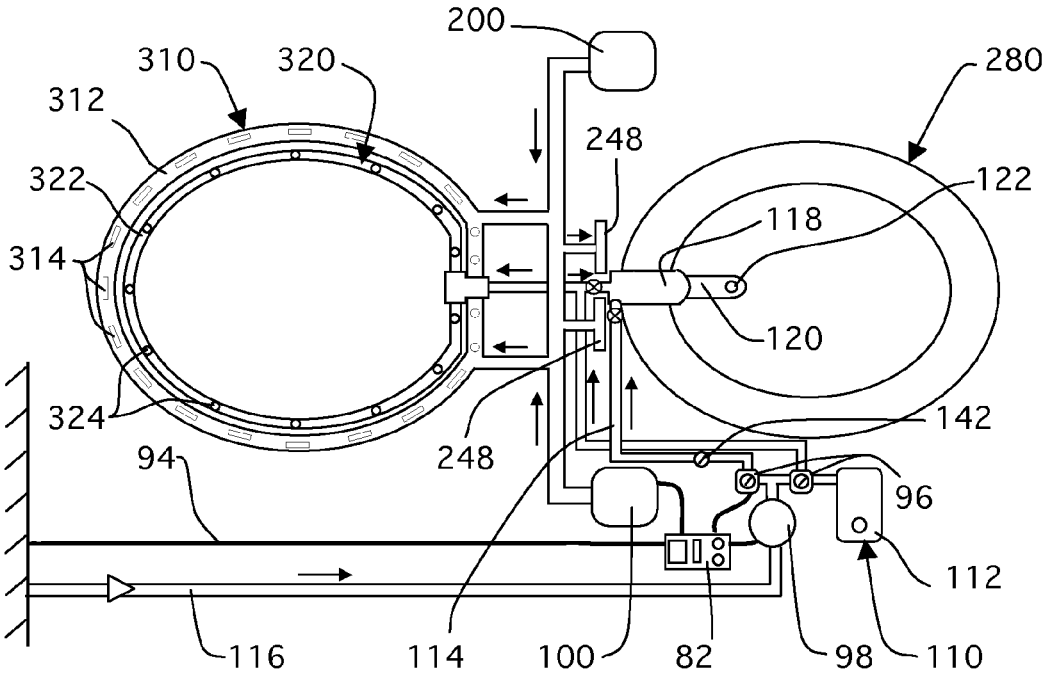
FIG. 7 is a schematic diagram of the instant invention.

Liquid matter system 110 includes disinfectant container 112 housed within tower assembly 30, connecting tube 114, and bidet base 118 having telescopic section 120 and bidet nozzle 122 at its distal end. Liquid matter system 110 further includes line 116 from a water source, which is best seen in FIG. 7.

As also seen in FIG. 3, manifold assembly 220 has wall 222 with ends 224 and 226, cutouts 228 and 232, and central cutout 230. Manifold assembly 220 further comprises air ducts 234 and 236 that mount to conduits 52 and 152 of top switch housing 50 and top regulator housing 150 respectively. Connecting tube 114 goes through manifold assembly 220. Bidet base 118 with telescopic section 120 are partially housed within manifold assembly 220 and protrude through central cutout 230.

Manifold 240 is mounted with mounting posts 250 passing through standard openings in toilet bowl 406 used for mounting of traditional toilet seats. Manifold 240 comprises housing 242 with ends 244 and 246. Manifold flaps 248 are cooperatively disposed at a forward section of manifold 240. Manifold flaps 248 have spring-loaded hinges, not seen. Tubular cutout 252 is also at the forward section of manifold 240 between manifold flaps 248.

Toilet seat assembly 270 has mounting brackets 272 and inner edge 274.

Mounting brackets 272 mount to ends 244 and 246 of manifold 240. Mounting frames 290 mount next to mounting brackets 272. It is noted that manifold assembly 220 passes through manifold 240, mounting brackets 272, and mounting frames 290. Proximal ends of air ducts 234 and 236 are mounted to mounting frames 290, which in turn are next to ends 224 and 226 of manifold assembly 220. Bidet base 118 is positioned through central cutout 230 of manifold assembly 220, and through an opening of manifold 240, not shown, to be cooperatively disposed at tubular cutout 252.

It is noted that manifold assembly 220, manifold 240, mounting brackets 272, and mounting frame 290 are on a same axis.

Figure 4:
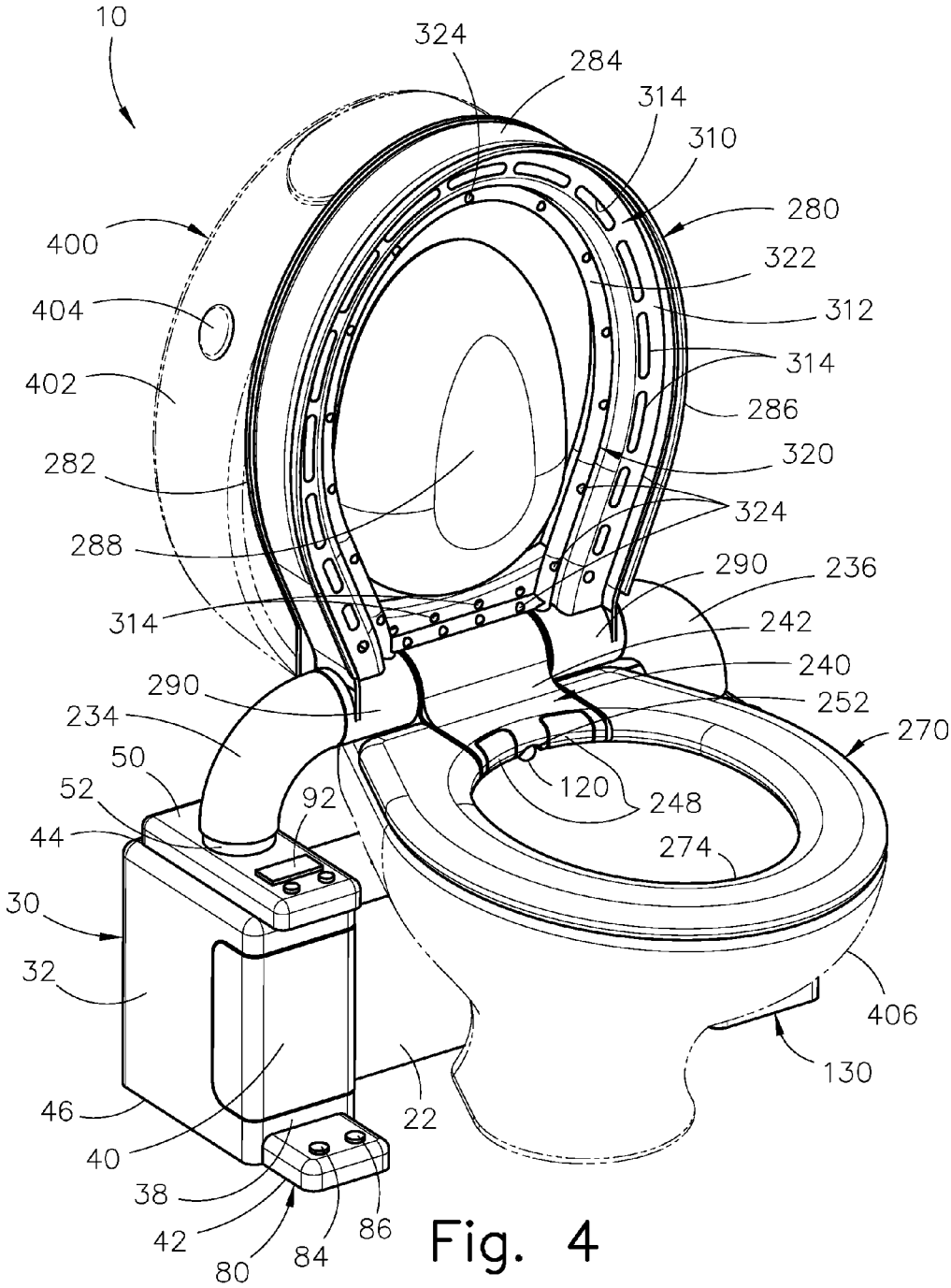
FIG. 4 is an isometric view of the instant invention with its cover assembly in an open position and installed onto the standard toilet.
Figure 5A:
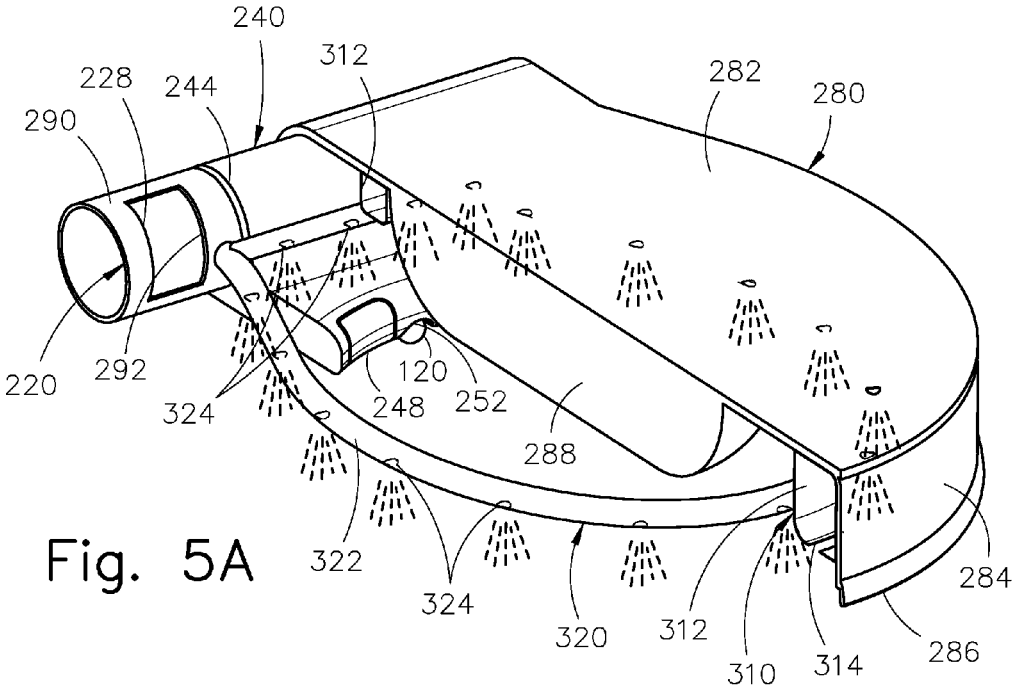
FIG. 5A is a partially sectioned isometric view of the cover assembly in the closed position and showing an activated liquid matter duct assembly.

As seen in FIG. 4, cover assembly 280 comprises top wall 282, best seen in FIG. 1, side wall 284 with edge 286, protrusion 288, and mounting frames 290 with cutouts 292, seen in FIG. 5A. Air duct assembly 310 and liquid matter duct assembly 320 are mounted onto cover assembly 280 between sidewall 284 and protrusion 288. Air duct assembly 310 has air conduit 312 with cutouts 314. Liquid matter duct assembly 320 has liquid matter conduit 322 with cutouts 324.

Figure 5B:
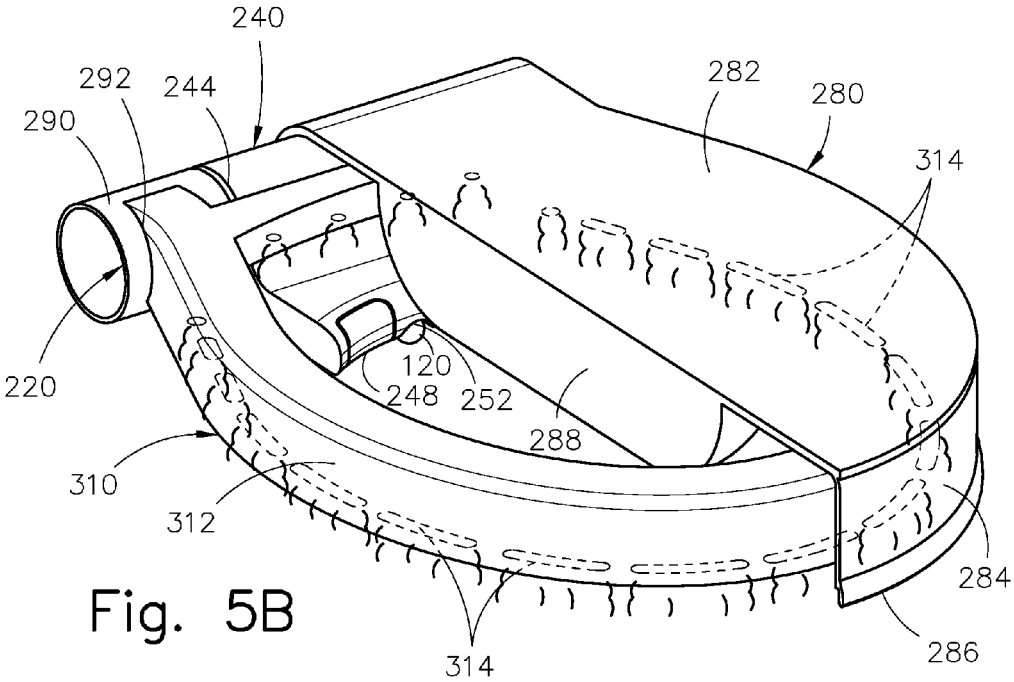
FIG. 5B is a partially sectioned isometric view of the cover assembly in the closed position and showing an activated air duct assembly.

As seen in FIGS. 5A and 5B, cover assembly 280 has been partially cross-sectioned to show how interior parts work. It is noted that when cover assembly 280 is closed, cutouts 228 and 232 of manifold assembly 220 are aligned with cutouts 292 of mounting frames 290, thus permitting air flowing from turbine assemblies 100 and 200 to flow through air duct assembly 310. Also, side wall 284 is positioned around an external edge of toilet seat assembly 270 and protrusion 288 and cooperatively fits inner edge 274, resting upon toilet seat assembly 270 in a way that a there is a clearance between protrusion 288 and inner edge 274 at front and sides. However, a rear portion of protrusion 288 snugly fits to the front of manifold 240, thus preventing manifold flaps 248 from opening when cover assembly 280 is closed.

In operation, liquid matter duct assembly 320 is activated with switch 84 or 88, whereby liquid matter is delivered through cutouts 324 for a predetermined period of time onto toilet seat assembly 270. The disposition of sidewall 284 and protrusion 288 forces the delivered liquid matter to be directed inside toilet bowl 406. Once the cycle above has finished, a displacing and drying cycle starts. Air flowing from turbine assemblies 100 and 200 is directed through air ducts 234 and 236, cutouts 228 and 232, and then cutouts 292 into air conduit 312, exiting through cutouts 314 to displace and/or dry the liquid matter from the surface of toilet seat assembly 270. Instant invention 10 is then clean, sanitized, and ready for use by a user.

Figure 6A:
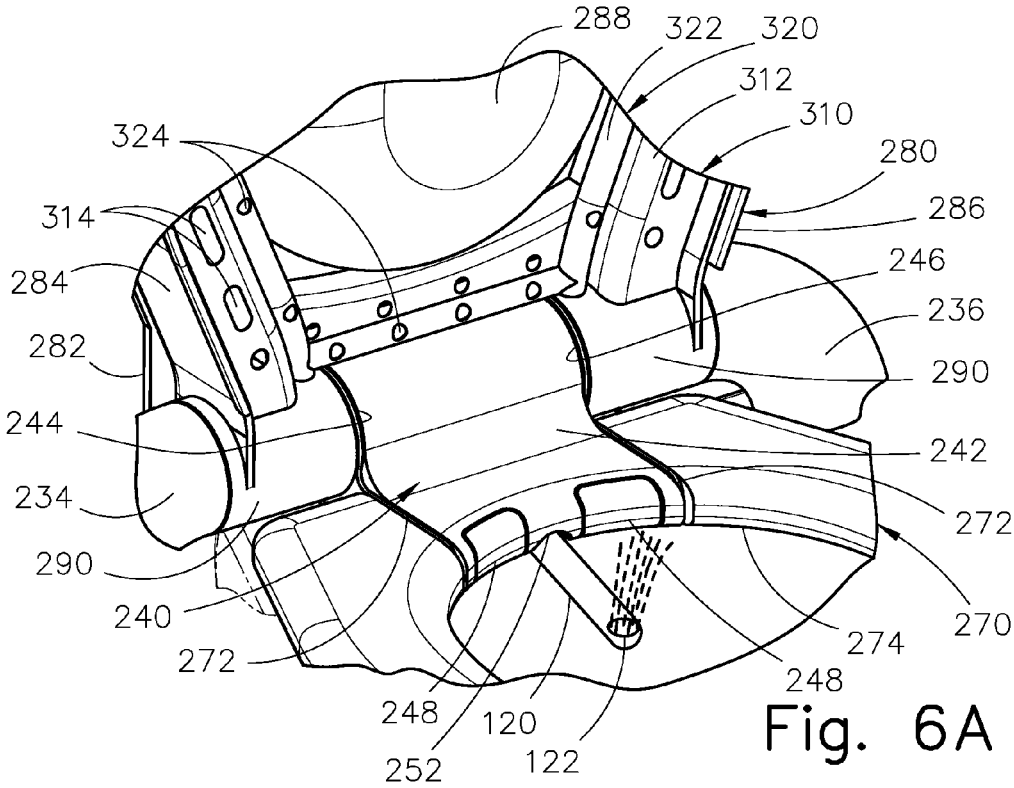
FIG. 6A is a partially sectioned isometric view of the instant invention, showing a bidet nozzle extended and in use.
Figure 6B:
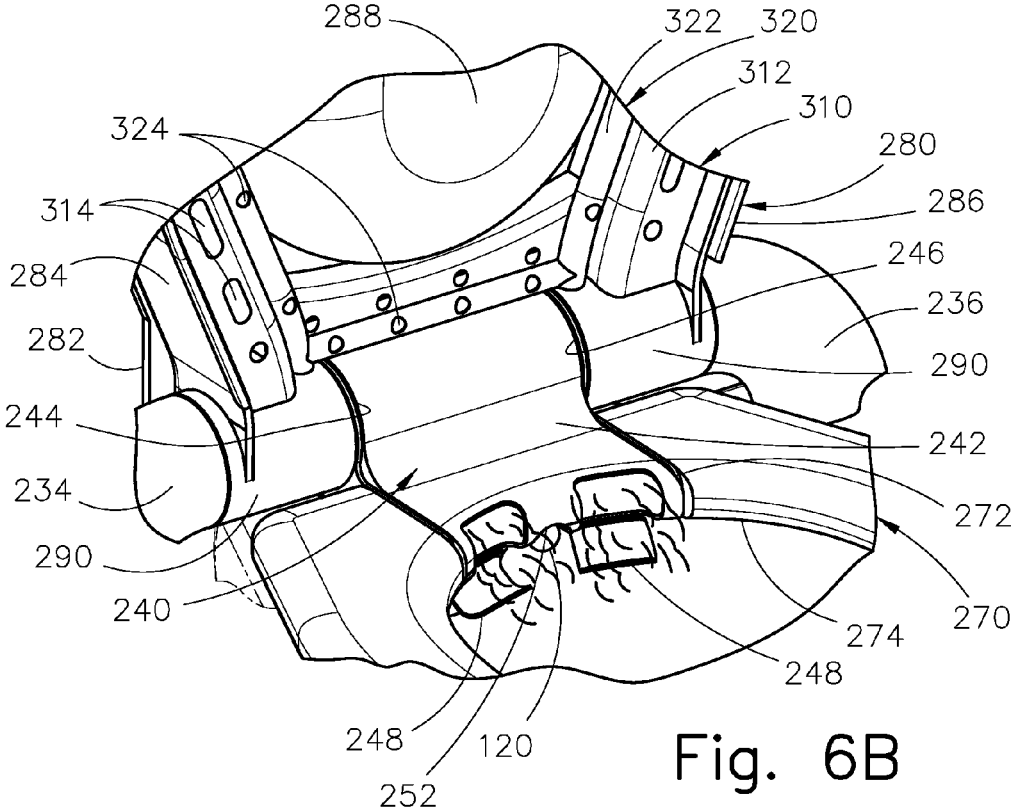

As seen in FIGS. 6A and 6B, once a user uses toilet 400, especially upon voiding, switch 86 or 90 is pressed to activate an anal cleaning cycle. Impeller pump 98 causes the liquid matter to be expelled through bidet nozzle 122 for a predetermined period of time. The user can regulate the pressure of the liquid matter exiting bidet nozzle 122 by actuating pressure regulator 142. Liquid matter pressure causes telescopic section 120 to extend from bidet base 118. When the anal cleaning cycle ends, telescopic section 120 retracts back into bidet base 118 and the anal drying cycle starts. Since cover assembly 280 is in an open position, cutouts 292 are covered by wall 222 of manifold assembly 220. Therefore, air flowing from turbine assemblies 100 and 200 forces manifold flaps 248 to open. Air flowing through flaps 248 is directed to the user's anal area for a predetermined period of time.

Seen in FIG. 7 is a schematic diagram of the connections for instant invention 10. Water enters from a water source through line 116, having a one-way valve, flows to impeller pump 98. Liquid matter flow is selectively directed by electrical valves 96; either to liquid matter duct assembly 320, along with a predetermined amount of disinfectant from disinfectant container 112, or to bidet nozzle 122 with a pressure that user determines using pressure regulator 142. Electrical wiring supplies electrical power to control box 82, which in turn is connected to turbine assemblies 100 and 200, impeller pump 98, and electrical valves 96. Retention valves can be conveniently disposed to control the direction of the water flow.

FIGS. 8A, 8B, 8C, 8D and 8E represent timing charts showing different dispositions and states of the components of instant invention 10 in a period of time as follows:

1. Period of Time AB: Seat Disinfectant Cycle:

FIG. 8A: Cover assembly 280 is in a closed position.

FIG. 8B: Liquid matter is delivered through cutouts 324 of liquid matter duct assembly 320 and onto toilet seat assembly 270.

FIG. 8C: Air from turbine assemblies 100 and 200 to air duct assembly 310 are OFF.

FIG. 8D: Water flow from impeller pump 98 to bidet nozzle 122 is OFF.

FIG. 8E: Air flow from turbine assemblies 100 and 200 to manifold flaps 248 is OFF.

2. Period of Time BC: Seat Drying Cycle Starts:

FIG. 8A: Cover assembly 280 is in a closed position.

FIG. 8B: Liquid matter duct assembly 320 is OFF.

FIG. 8C: Air from turbine assemblies 100 and 200 to air duct assembly 310 is ON. Air flowing from turbine assemblies 100 and 200 is directed through air ducts 234 and 236, cutouts 228 and 232, cutouts 292 into air conduit 312, exiting through cutouts 324 to displace and/or dry the liquid matter from toilet seat assembly 270.

FIG. 8D: Water from impeller pump 98 to bidet nozzle 122 is OFF.

FIG. 8E: Air flowing from turbine assemblies 100 and 200 to manifold flaps 248 is OFF.

3. Period of Time CD: Anal Cleaning Cycle:

FIG. 8A: Cover assembly 280 is in an open position.

FIG. 8B: Liquid matter duct assembly 320 is OFF.

FIG. 8C: Air flow from turbine assemblies 100 and 200 to air duct assembly 310 is OFF.

FIG. 8D: Water flow from impeller pump 98 to bidet nozzle 122 is ON. Water flowing from impeller pump 98 is expelled through bidet nozzle 122. Liquid matter pressure makes telescopic section 120 protrude from bidet base 118.

FIG. 8E: Air flow from turbine assemblies 100 and 200 to manifold flaps 248 is OFF.

4. Period of Time DE: Anal Area Drying Cycle:

FIG. 8A: Cover assembly 280 is in an open position.

FIG. 8B: Liquid matter duct assembly 320 is OFF.

FIG. 8C: Air from turbine assemblies 100 and 200 to air duct assembly 310 is OFF.

FIG. 8D: Water flow from impeller pump 98 to bidet nozzle 122 is OFF.

FIG. 8E: Air flow from turbine assemblies 100 and 200 to manifold flaps 248 is ON. Air flowing from turbine assemblies 100 and 200 forces manifold flaps 248 to open. Air flowing out through manifold flaps 248 is directed to the user's anal area.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A combined automatic toilet seat-cleaning and user hygienic system, comprising:

A) a housing assembly;

B) an electrical system;

C) a liquid matter system;

D) a turbine assembly;

E) a manifold assembly comprising a first at least one cut out, said manifold assembly partially housed within a manifold, said manifold assembly having ducting for air to flow originating from said turbine assembly, said manifold assembly further comprising a bidet nozzle for liquid matter to exit from said liquid matter system directed onto a user positioned on a toilet seat assembly;

F) said toilet seat assembly having mounting brackets to mount onto said manifold assembly for rotary movement of said seat assembly; and G) a cover assembly having a mounting frame to mount onto said manifold assembly, said cover assembly having a second at least one cutout for said air to flow originating from said turbine assembly, said cover assembly further having a third at least one cutout for said liquid matter to exit therefrom and being directed onto said toilet seat assembly in a manner so as to provide cleaning of said toilet seat assembly.

2. The combined automatic toilet self-cleaning and user hygienic system set forth in claim 1, further characterized in that said liquid matter exits from said third at least one cutout when said cover assembly is in a closed position.

3. The combined automatic toilet self-cleaning and user hygienic system set forth in claim 1, further characterized in that said air flows from said first at least one cut out when said cover assembly is in a closed position.

4. The combined automatic toilet self-cleaning and user hygienic system set forth in claim 1, further characterized in that said liquid matter exits from said bidet when said cover assembly is in an open position.

5. The combined automatic toilet self-cleaning and user hygienic system set forth in claim 1, further characterized in that said manifold comprises at least one manifold flap that opens when said air flows therefrom from said turbine assembly when said cover assembly is in an open position.

6. The combined automatic toilet self-cleaning and user hygienic system set forth in claim 1, further characterized in that said cover assembly further comprises a protrusion that rests upon said toilet seat assembly when said cover assembly is in a closed position.

7. The combined automatic toilet self-cleaning and user hygienic system set forth in claim 1, further characterized in that said liquid matter system comprises a disinfectant container.

8. The combined automatic toilet self-cleaning and user hygienic system set forth in claim 1, further characterized in that said liquid matter system comprises a pressure regulator to regulate pressure of said liquid matter exiting from said bidet when said cover assembly is in an open position.

9. The combined automatic toilet self-cleaning and user hygienic system set forth in claim 1, further characterized in that said electrical system comprises at least one switch to activate said liquid matter system and said turbine assembly.

10. The combined automatic toilet self-cleaning and user hygienic system set forth in claim 1, further characterized in that said bidet is in a retracted position when said liquid matter exits from said third at least one cutout when said cover assembly is in a closed position.

11. The combined automatic toilet self-cleaning and user hygienic system set forth in claim 1, further characterized in that said bidet is in a retracted position when said air flows from said first at least one cut out when said cover assembly is in a closed position.

12. The combined automatic toilet self-cleaning and user hygienic system set forth in claim 1, further characterized in that said bidet is in a extracted position when said liquid matter exits from said bidet when said cover assembly is in an open position.

13. The combined automatic toilet self-cleaning and user hygienic system set forth in claim 5, further characterized in that said bidet is in a retracted position when said at least one manifold flap opens and said air flows therefrom originating from said turbine assembly when said cover assembly is in an open position.

14. The combined automatic toilet self-cleaning and user hygienic system set forth in claim 1, further characterized in that said turbine assembly has sufficient power to displace and dry said liquid matter from said toilet seat assembly when said air flows from said first at least one cut out when said cover assembly is in a closed position.

15. The combined automatic toilet self-cleaning and user hygienic system set forth in claim 1, further characterized in that said housing assembly comprises at least one tower assembly to house said turbine assembly.

16. The combined automatic toilet self-cleaning and user hygienic system set forth in claim 1, further characterized in that said liquid matter system connects to a water source.

17. The combined automatic toilet self-cleaning and user hygienic system set forth in claim 1, further characterized in that said housing assembly comprises two tower assemblies to each house a respective said turbine assembly.

18. The combined automatic toilet self-cleaning and user hygienic system set forth in claim 17, further characterized in that said ducting extends from said two tower assemblies to said manifold assembly.

19. The combined automatic toilet self-cleaning and user hygienic system set forth in claim 1, further characterized in that said housing comprises a base switch housing to house at least one switch to activate said liquid matter system and said turbine assembly.

20. The combined automatic toilet self-cleaning and user hygienic system set forth in claim 1, further characterized in that said manifold assembly, said manifold, said mounting brackets, and said mounting frame are on a same axis.

* * * * *